United States Patent [19]

Rohrssen

[11] 3,971,619

[45] July 27, 1976

[54] SAFE ELECTRICAL CONNECTOR

[76] Inventor: Donald J. Rohrssen, 511 Broadway, Rock Springs, Wyo. 82901

[22] Filed: May 27, 1975

[21] Appl. No.: 580,951

Related U.S. Application Data

[63] Continuation of Ser. No. 430,786, Jan. 4, 1974, abandoned.

[52] U.S. Cl. ..... 339/189 R

[51] Int. Cl.[2] ..... H01R 33/46

[58] Field of Search ..... 174/66; 339/36, 99 R, 339/188 R, 188 C, 189 R, 207 R, 207 S, 193 P

[56] References Cited

UNITED STATES PATENTS

| | | | |
|---|---|---|---|
| 1,294,444 | 2/1919 | Goetzelman | 339/189 R |
| 2,730,690 | 1/1956 | Harasek | 339/193 |
| 3,208,035 | 9/1965 | Horvath | 339/189 R |
| 3,299,391 | 1/1967 | Herrmann | 339/99 R |
| 3,685,007 | 8/1972 | Riley | 339/189 R |

FOREIGN PATENTS OR APPLICATIONS

| | | | |
|---|---|---|---|
| 78,644 | 7/1962 | France | 339/188 C |

*Primary Examiner*—Roy Lake
*Assistant Examiner*—Mark S. Bicks
*Attorney, Agent, or Firm*—B. Deon Criddle

[57] ABSTRACT

A low cost, grounded electrical connector including an outlet receptacle and a plug that greatly reduces the possibility for injuries to children resulting from electrical connectors. The receptacle has electrical contacts that are offset from openings through which prongs of the plug are inserted, and the contacts and the prongs are constructed to provide a positive lock when electrical contact is made.

8 Claims, 6 Drawing Figures

SAFE ELECTRICAL CONNECTOR

This is a continuation of applicaton Ser. No. 430,786, filed Jan. 4, 1974, now abandoned.

BRIEF DESCRIPTION OF THE INVENTION

1. Field of the Invention

This invention relates to electrical connectors such as are commonly found in homes and other structures and that include an electrical receptacle, usually mounted in a wall or other surface or forming part of an extension cord or the like, and a plug that is adapted to be inserted into the receptacle for the transmission of electrical power from the receptacle to another electric powered device or through a cord.

2. Prior Art

The need for safety-type electrical connectors has long been recognized. It is well known that children are particularly susceptible to injury through playing with or using the presently available electrical connector units. For example, a child may be severely injured through inserting hairpins or other conductive objects into a standard electrical receptacle or by shorting across the electrical prongs of a plug that is only partly inserted into an electrical receptacle. It is desirable, therefore, that a safe electrical connector be constructed such that metallic objects inserted into the receptacle of the connector will not automatically come in contact with electrical connections to complete a circuit. It is also desirable that some means be provided to prevent contact of the prongs of the plug of the connector with the electrical contacts of the receptacle until such time as the plug has been fully inserted into the receptacle, that the fully inserted plug be securely locked into the receptacle, and that the connector be constructed such that a conductive member cannot be connected across prongs of a fully inserted plug.

There are a number of patents disclosing electrical connectors wherein a plug that is inserted into a receptacle must be turned before electrical contact is made through the plug and in order to provide a secure lock between the receptacle and the plug. However, so far as I am aware, these proposed structures have not been commercially acceptable. It is believed that the lack of success of the prior known structures is due to their complex construction, the expense involved in producing them, and, in some cases at least, because they are not sufficiently child-proof.

SUMMARY OF THE INVENTION

Principal objects of the present invention are to provide an electrical connector that can be economically produced, readily installed, safely and easily used by those persons mature enough to properly use the connector, and difficult for a child to use in such a manner that he may be shocked or burned.

Another object is to provide an electrical connector having a receptacle that can be readily installed in place of the electrical receptacles commonly in use.

Still other objects are to provide an electrical connector of the locking type, wherein the plug component includes polarity oriented prongs and a ground prong, and wherein the receptacle contains openings to receive the prongs while maintaining electrical polarity and insuring a good ground contact.

Principal features of the invention include an electrical receptacle comprising a plate having one display surface, preferably having a central circular recess and circuits opposite surface of the plate. Openings are provided through the plate, adjacent to, but offset from, contact terminals provided at ends of leads of the circuits and the openings are made to have different configurations that will accommodate correspondingly shaped prongs projecting from the connector plug. Resilient terminals on the ends of the circuit leads provide locking means for securing the prongs of the plug against inadvertent turning.

Additional objects and feaures will become apparent to those skilled in the art from the following detailed description and claims, taken with the accompanying drawings. THE DRAWINGS In the drawings:

FIG. 1 is a perspective view of the connector of the invention, with the receptacle mounted in a wall and with one plug inserted into the receptacle, and the other plug separated therefrom;

FIG. 2, a perspective view taken at the end of the plug from which the prongs thereof project;

FIG. 3, a view like that of FIG. 1, but with the receptacle pivoted to a lowered or open position;

FIG. 4, a view like FIG. 1, showing another embodiment of the invention, with the plug removed from the receptacle;

FIG. 5, a view like FIG. 2, but showing the plug of FIG. 4; and

FIG. 6, a view like FIG. 3, but showing the embodiment of FIG. 4.

DETAILED DESCRIPTION

Figure 1:
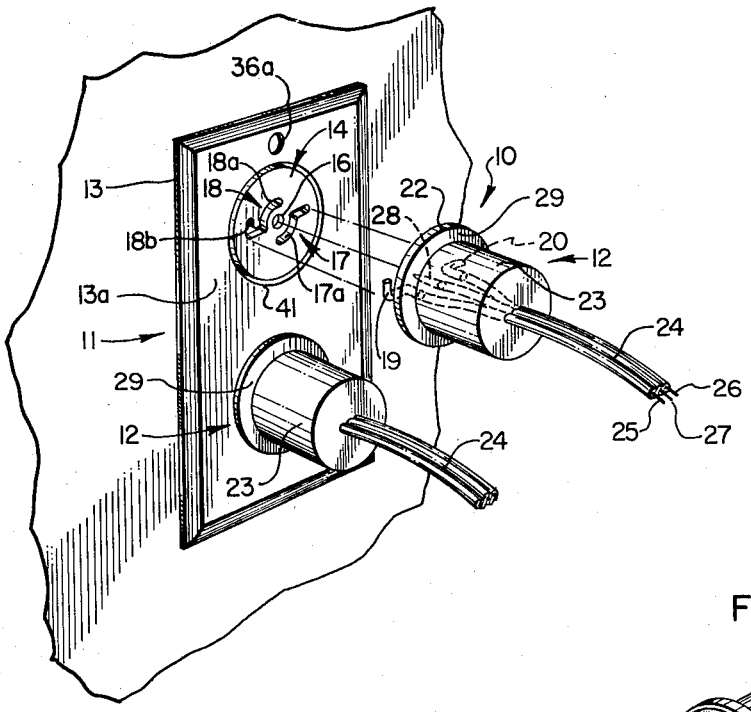
Figure 2:
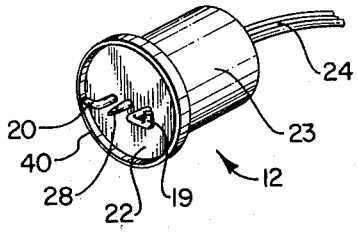

Referring now to the drawings:

In the preferred embodiment of the invention illustrated in FIGS. 1 and 2, the electrical connector, shown generally at 10, includes a receptacle 11 and at least one plug 12.

The receptacle component 11 comprises a face plate 13 having one display face 13*a* and an opposite face 13*b*, having printed circuit leads thereon. Spaced apart sets of openings 14 and 15 each include a central hole 16 and slots 17 and 18, respectively, at opposite sides of the hole 16. Slots 17 and 18 include arcuate portions 17*a* and 18*a*, respectively, with each arcuate portion having a center of rotation at the middle of the hole 16. Slot 17 has another portion 17*b* at one end of the arcuate portion 17*a* and extending substantially normal thereto. Slot 18 has a substantially L-shaped portion 18*b*, one leg of which is connected to one end of the arcuate portion 18*a*. So constructed, the slots 17 and 18 are shaped to conform to the prongs 19 and 20 of the electrical plug 12.

Prong 20 extends from the face 22 of plug 12 and is angled at 20*a* to extend substantially normal to the portion of the prong projecting from the plug.

Prong 19 also extends from the face 22 of plug 12 and is angled at 19*a* to extend substantially normal to the portion of the prong projecting from the plug, and in a direction opposite to that of 20*a*. Prong 19 has a further angled portion 19*b*, extending substantially normal to the section 20*a* and in the same plane as the sections 19*a* and 20*a*.

Plug 12 preferably has a body 23 that is molded to an electrical cord 24, such that the prongs 19 and 20 are electrically connected to the circuit wires 25 and 26, respectively, of the cord. Ground wire 27 of the cord is also connected to a central, straight prong 28 that projects from the face 22 of plug 12. Face 22 is preferably formed as one side of an enlarged head 29 on the end of body 23. The enlarged head effectively prevents the fingers of a user of the plug from slipping along the body 23 and into engagement with the prongs 19 and 20 or from blocking locking movement of the plug.

An electrical contact member 30 is placed adjacent to one of the ends of each of the slots 17 and 18 on the rear surface of face plate 13 opposite to that through which the prongs of the plug are inserted. The contact members are positioned such that after the prongs have been inserted and turned, i.e. in a clockwise direction, the prongs each come into engagement with a contact member. Further turning will then move the prongs over a raised detent 30*a* of each contact member so that the prongs will not inadvertently turn back to release the plug from the receptacle.

The contact members 30 are each electrically connected to printed circuit leads 31 formed in the rear surface, i.e. circuit face of the face plate 13 and the leads each extend to and are electrically connected to a screw-type electrical connector 32. Thus, after the prongs 19 and 20 have been inserted through the face plate 23 and have been turned within the arcuate portions of slots 17 and 18 into engagement with contact members 30, a circuit is completed from power wires connected to the screw type connectors 32, leads 31, contact members 30, prongs 19 and 20 and cord 24 to whatever electrically operated device may be connected to the other end of the cord 24. Because the prongs 19 and 20 are of different shapes and will fit only through the slots shaped to receive them, electrical polarity between the receptacle and the plug is maintained.

The grounded central prong 28 fits through the central hole 16 at the same time as prongs 19 and 20 are respectively inserted through the slots 17 and 18 and the prong 28 then serves as a pivot shaft about which the prongs 19 and 20 are rotated. A flexible conductive bar 33 is electrically connected to a screw-type connector 34, adjacent to the screw-type connectors 32 and the bar extends across each hole 16 at a location just slightly off-center. Each prong 28 has a rounded tip, and as the prong is inserted through a hole 16, it engages the bar 33, which flexes to allow full insertion of the prong 28, and that then tends to bind the prong against the edge of hole 16, to insure better holding of the plug within the receptacle.

While it will be apparent that the face plate 13 can be used as an end of an extension cord or with any conventional outlet box, such as is shown at 36, it can also be used with much shallower boxes than are conventionally used, since there is no separate, bulky socket to be inserted in the box. The power lines coming into the box may enter through knock-outs in the rear, top or sides of the box, as is conventional.

It will also be apparent that the face plate 13 can be attached to the box by top and bottom screws inserted through the face plate and threaded into holes provided therefore in the box. However, when the face plate is to be used with an outlet box, it is preferred that a hinge 37 be formed at one end of the face plate, with a flap 18 extending from the hinge. A screw 39 is then inserted through a hole in the flap to fasten the flap to one end of the box 36. The plate 13 can then be pivoted from a position projecting out from the box, at which position the power line wires can be attached to the screw-type connectors and a raised position wherein the plate covers the box and is flush against the wall in which the box 36 is recessed, A screw 39*b* is inserted through a hole 39*a* in the face plate to secure the face plate in the raised position.

While the prongs 19 and 20 are here shown as having a circular cross-section, it will be apparent that they could as well be made of flat stock, with a rectangular cross-section. If the prongs are made somewhat resilient and made to properly project from the face of plate 13 they will securely engage the contact members 30 after moving over detents 30*a* to make a non-sparking contact and to prevent withdrawl of the plug with a prior intended turning of the plug. Once the turning is initiated to release the plug from the receptacle and even before the prongs are aligned with the slots to allow withdrawal, the circuit connection between the receptacle and the plug is broken. Thus, there is no possibility that contact elements having a current therethrough can be engaged by a user.

It is also preferred that the enlarged head 29 having a projecting peripheral ring 40 that will fit into a groove 41 provided in the face plate 13 and surrounding the openings 16–18. With the ring 40 extending into the groove 41 when the plug is fully inserted and an electrical circuit is completed through the connector 10, there is no possibility that a knife blade or other thin conductive member could be slipped between the plug 12 and the face plate 13 to short across the prongs 19 and 20.

Figure 3:
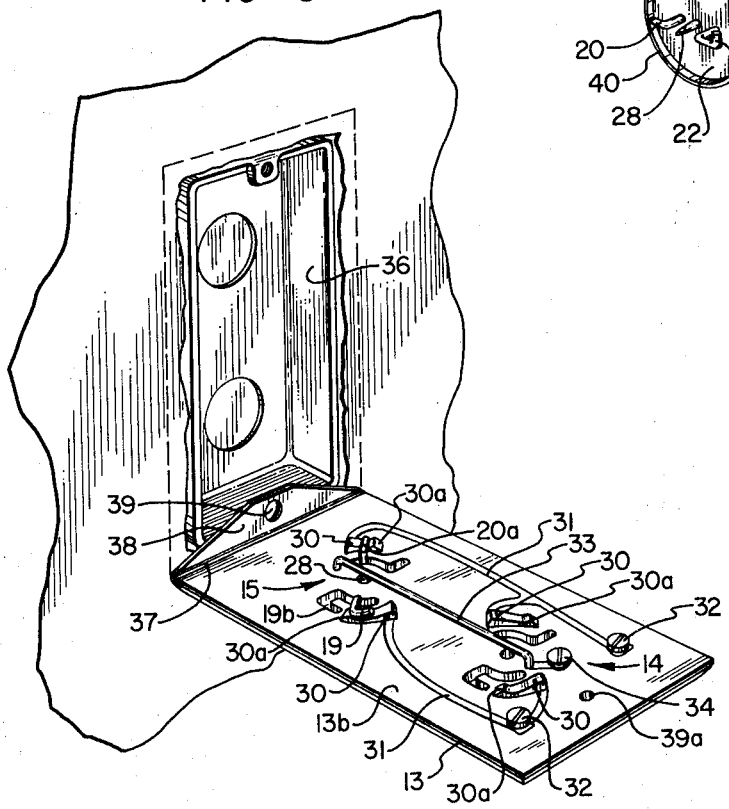

While the embodiment of FIGS. 1–3 has shown an arrangement including printed circuit leads, screw-type connectors, and the like, it should be recognized that these are preferred components, but that other conventional components can be alternatively used. Also, while the illustrated preferred embodiment shows a central grounding prong and diametrically placed polarity oriented plugs that rotate about the central grounding plug, other arrangements could be used. For example, a non-conductive central post (not shown) could be used and all prongs, including the grounding prong could be radially spaced around the central post. The radially spaced prongs would all make contact with contact members provided at the ends of openings in the faceplate through which the prongs are inserted. Polarity would still be maintained by having one prong of a unique shape and one opening through the face plate to receive the uniquely shaped prong.

Figure 4:
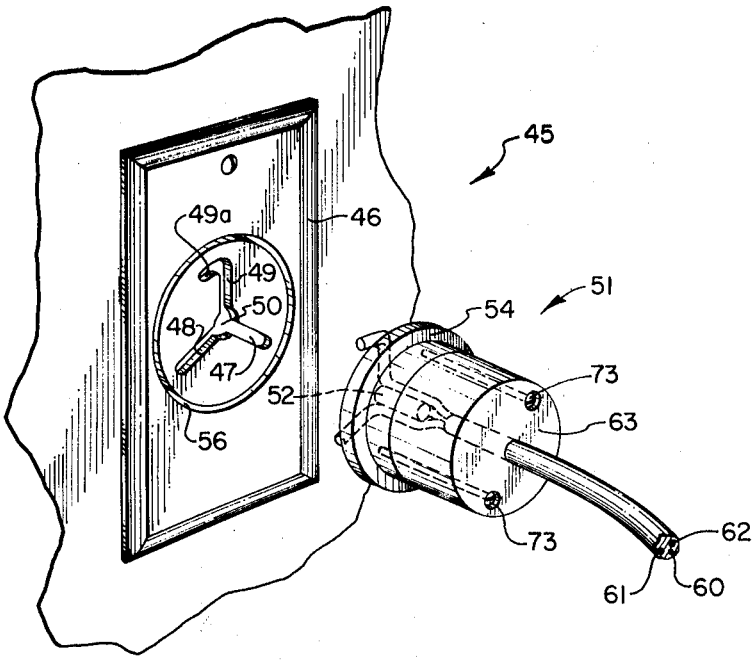
Figure 5:
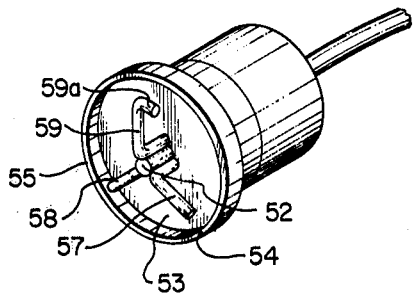
Figure 6:
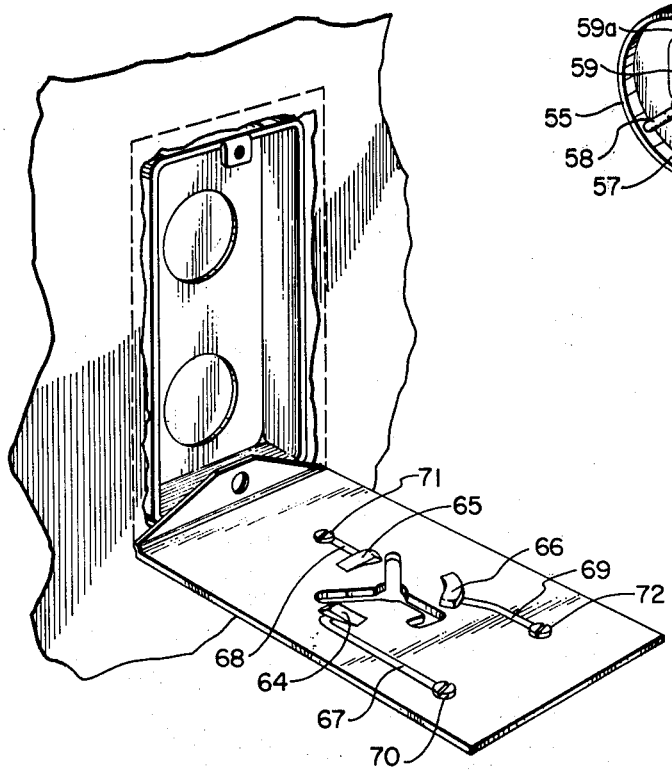

Another embodiment of the invention is shown in FIGS. 4–6. In this embodiment, the connector, shown generally at 45, includes a face plate 46, constructed essentially like the face plate 13, previously described, but including a set of openings comprising slots 47, 48 and 49, all radiating from a central opening 50. Slot 49 has an angled tip 49*a* to make it unique from slots 47 and 48.

Connector 45 also includes a plug, shown generally at 51. Plug 51 has an insulated, non-conducting member 52 projecting through and from a face 53 of an enlarged heat 54. The head 54, like the head 29, previously described, preferably has a projecting ring 55 that will fit into a groove 56 on the face plate 46 to prevent shorting across electrically connected prongs.

Three prongs 57, 58 and 59 project through and from face 53 and are held separated by member 52. A power wire having a ground wire 60 and circuit wires 61 and 62 extends through a housing portion 63 to be soldered, clamped or otherwise respectively connected to the prongs 57, 58 and 59. Prong 59 is angled at 59*a* so that it will have a shape corresponding to slot 49 and so that polarity will be maintained when the prongs are inserted through the face plate and are turned to be in contact with contact members 64, 65 and 66, positioned adjacent to the slots at the circuit face 46*a* of face plate 46. Through circuit leads 67, 68 and 69, the contact members 64, 65 and 66 are respectively connected to a screw-type terminal connectors 70, 71 and 72, to which the ground wire and electrical contacts of a power line are connected.

Although a preferred form of my invention has been herein disclosed, it is to be understood that the present disclosure is by way of example, and that variations are possible without departing from the subject matter of the following claims, which subject matter I regard as my invention.

I claim:

1. An electrical connector comprising a receptacle having a face plate with one display face and a circuit face, at least one of set openings through the face plate, including an opening for a ground prong and a pair of openings for circuit prongs, electrical contact members offset from but adjacent to at least two openings of the set, said electrical contact members each having an inclined plane projecting outwardly from the circuit face and a detent projecting from the inclined plane whereby circuit prongs will pass over the detents to be securely held against the inclined planes of said contact members and to hold an electrical plug tightly against the display face, electrical connector terminals on the circuit face of the face plate, circuit means on the circuit face respectively interconnecting the electrical connector terminals with the electrical contact members; and an electrical plug having a plurality of electrical prongs projecting from one face of said plug, a pair of said prongs constituting circuit prongs and each having an angled portion extending therefrom, said angled portions being in essentially the same plane, being shaped to fit through the slots of a set of openings through the face plate, and being arranged to engage the inclined planes of the electrical contact members when said prongs are inserted through the face plate and are turned past the detents.

2. An electrical connector as in claim 1, wherein the plurality of electrical prongs include a pair of circuit prongs and a ground prong.

3. An electrical connector as in claim 1, wherein the circuit prongs are angled to have different configurations.

4. An electrical connector as in claim 3, wherein the ground prong is centrally located with respect to the circuit prongs.

5. An electrical connector as in claim 1, wherein the display face has a groove formed therein encircling the openings through the face plate; and the plug has a projecting ring encircling the prongs and extending into the groove when the prongs of the plug are in engagement with the electrical contact members on the circuit face of the face plate.

6. An electrical connector as in claim 1, wherein the prongs all extend centrally from the face and extend radially therefrom.

7. An electrical connector as in claim 6, further including non-conductive insulating means holding said prongs separated.

8. An electrical connector as in claim 1, wherein the face plate has a hinge at one end thereof and a hinge flap fixed to said hinge, and wherein means are provided to secure the hinge flap to an outlet box at one end thereof, and a hole through the face plate, whereby a screw can be inserted through the face plate at the end opposite to the hinge, to secure the plate to the box when the hinge plate is folded against the other portion of the face plate.

* * * * *